United States Patent [19]

Weis

[11] Patent Number: 5,054,338

[45] Date of Patent: Oct. 8, 1991

[54] COMBINATION CAP REMOVER AND CARTON TOP OPENER TOOL

[76] Inventor: Jonathan C. Weis, 9 Bluebird Dr., Syosset, N.Y. 11791

[21] Appl. No.: 606,555

[22] Filed: Oct. 31, 1990

[51] Int. Cl.[5] ..... B67B 7/44

[52] U.S. Cl. ..... 81/3.09; 81/3.4; 81/3.55

[58] Field of Search ..... 81/3.07, 3.09, 3.55, 81/3.47, 3.48, 3.4; D8/33, 40

[56] References Cited

U.S. PATENT DOCUMENTS

| | | | |
|---|---|---|---|
| 2,621,549 | 12/1952 | Rocereta | 81/3.47 |
| 2,793,549 | 5/1957 | DeLand | 81/3.55 |
| 4,455,894 | 6/1984 | Roberts | 81/3.09 |
| 4,633,740 | 6/1987 | Jacobs | 81/3.09 |
| 4,846,024 | 7/1989 | Bryant | 81/3.09 |

FOREIGN PATENT DOCUMENTS

| | | | |
|---|---|---|---|
| 2198714 | 6/1988 | United Kingdom | 81/3.4 |

*Primary Examiner*—Roscoe V. Parker
*Attorney, Agent, or Firm*—Michael I. Kroll

[57] ABSTRACT

A combination cap remover and carton top opener tool is provided and consists of a twist-off cap remover portion, a bottle cap remover portion and a carton top opener portion. The twist-off cap remover portion will break the seal of a tamper proof zip strip from a twist-off cap on a container. The bottle cap remover portion will lift off a bottle cap from a bottle. The carton top opener portion will break the seal between a pair of tabs on a top of a carton and form a pouring spout from two flaps.

3 Claims, 2 Drawing Sheets

Fig. 4
(STEP 1)
Fig. 4A
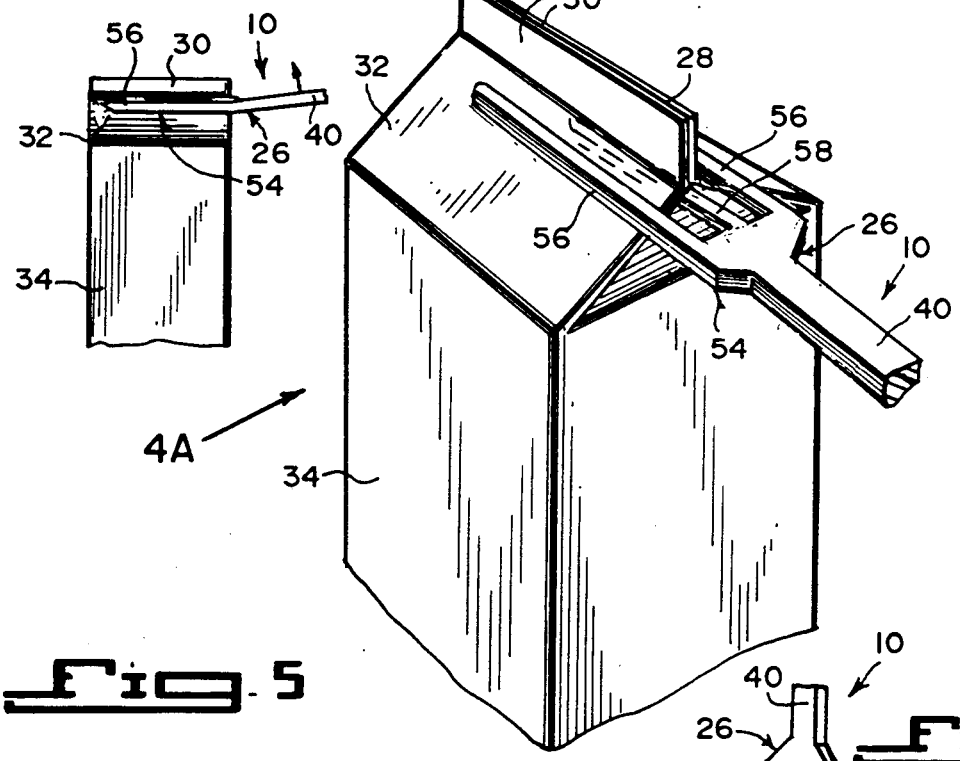
Fig. 5
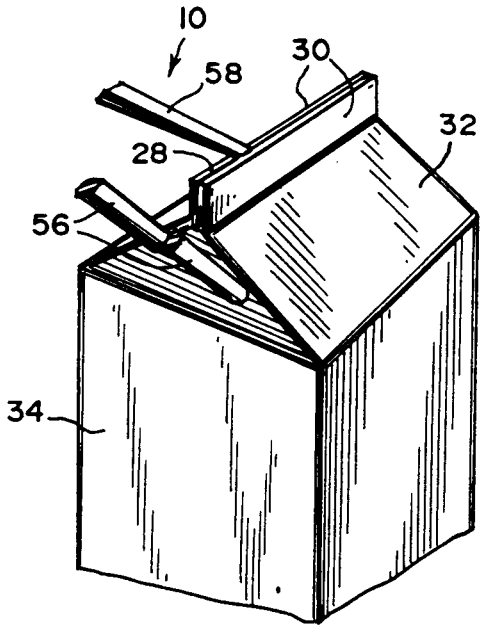
Fig. 6
(STEP 2)
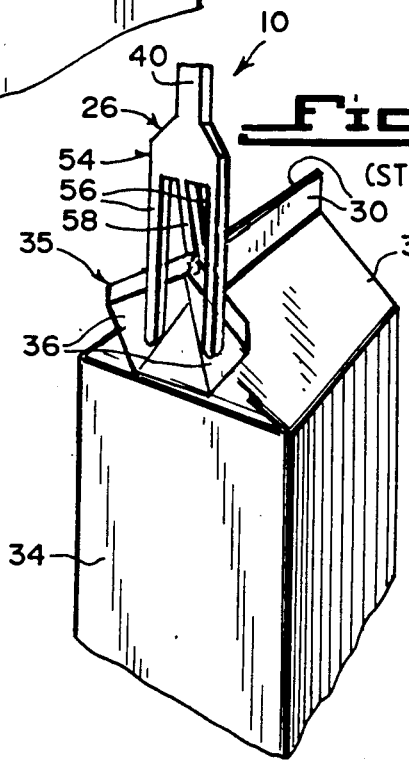

COMBINATION CAP REMOVER AND CARTON TOP OPENER TOOL

BACKGROUND OF THE INVENTION

1. Field of the Invention

The instant invention relates generally to openers and more specifically it relates to a combination cap remover and carton top opener tool.

2. Description of the Prior Art

Numerous openers have been provided in prior art that are adapted to remove caps and closures from various types of containers. While these units may be suitable for the particular purpose to which they address, they would not be as suitable for the purposes of the present invention as heretofore described.

SUMMARY OF THE INVENTION

A primary object of the present invention is to provide a combination cap remover and carton top opener tool that will overcome the shortcomings of the prior art devices.

Another object is to provide a combination cap remover and carton top opener tool that will facilitate the removal of a twist-off cap on a container and a bottle cap.

An additional object is to provide a combination cap remover and carton top opener tool that will also facilitate the opening of a carton top and forming the pouring spout thereon.

A further object is to provide a combination cap remover and carton top opener tool that is simple and easy to use.

A still further object is to provide a combination cap remover and carton top opener tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 4 is a perspective view showing the carton top opener portion inserted under the sealed tabs on the carton top.

FIG. 4A is a side view taken in direction of arrow 4A in FIG. 4.

FIG. 5 is a perspective view showing the carton top opener portion breaking the seal between the tabs on the carton top.

FIG. 6 is a perspective view showing the carton top opener portion opening the flaps on the carton top to form the pour spout thereon.

DETAILED DESCRIPTION OF THE PREFERRED EMBODIMENTS

Figure 1:
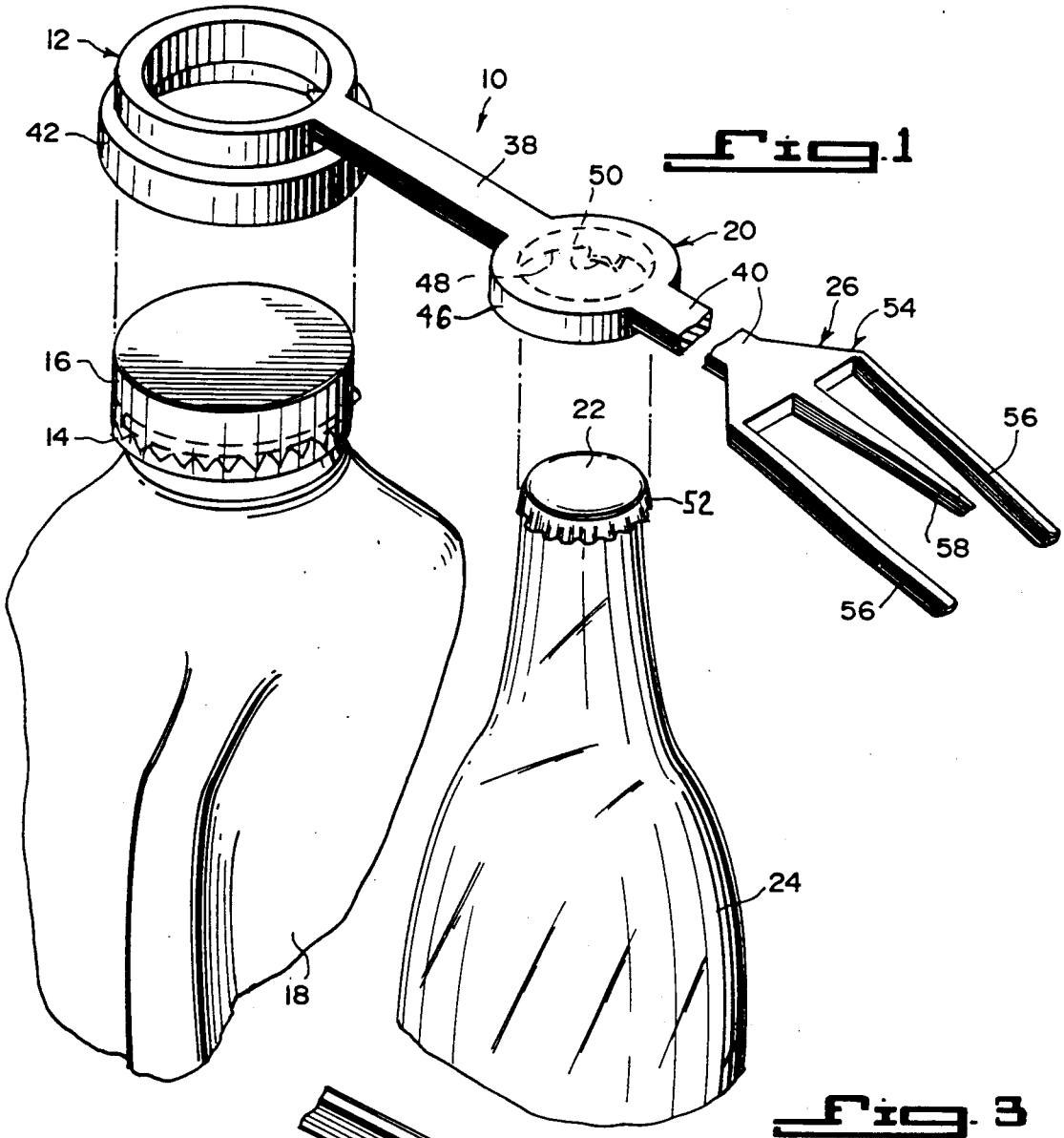
FIG. 1 is a perspective view with parts broken away of the instant invention ready to remove a twist-off cap and a bottle cap.
Figure 2:
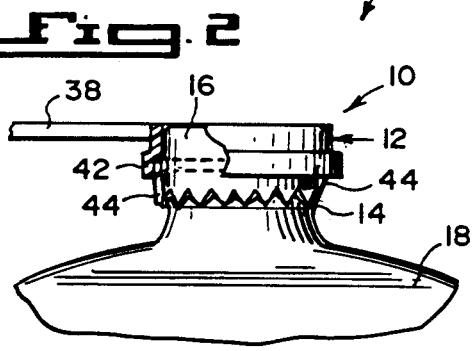
FIG. 2 is a side view with parts broken away and in section of the twist-off cap remover portion in engagement with a twist-off cap.
Figure 3:
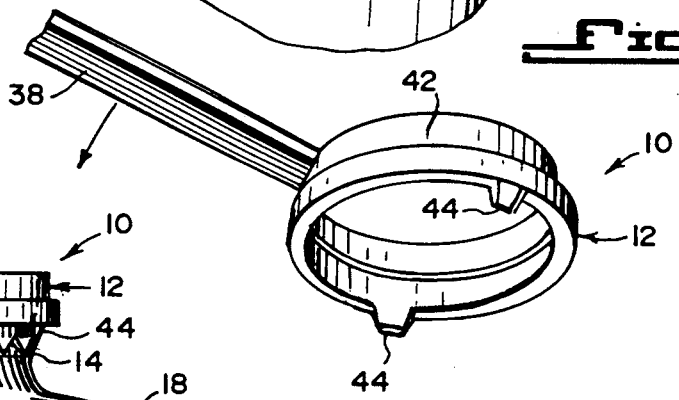
FIG. 3 is a bottom perspective view of the twist-off cap remover portion.

Turning now descriptively to the drawings, in which similar reference characters denote similar elements throughout the several views, the Figures illustrate a combination cap remover and carton top opener tool 10 consisting of a twist-off cap remover portion 12 to break the seal of a tamper proof zip strip 14 from a twist-off cap 16 on a container 18 so as to remove the twist-off cap 16 away from the container 18. A bottle cap remover portion 20 will lift off a bottle cap 22 on a bottle 24 so as to remove the bottle cap 22 away from the bottle 24. A carton top opener portion 26 will break the seal 28 between a pair of tabs 30 on a top 32 of a carton 34, such as used for milk, orange juice, etc. and form a pouring spout 35 from two flaps 36.

A first arm member 38 extends between the twist-off cap portion 12 and the bottle cap remover portion 20. A second arm member 40 extends between the bottle cap remover portion 20 and the carton top opener portion 26 to aid a person in manually operating the tool 10.

The twist-off cap remover portion 12 includes a collar 42 sized to fit over the twist-off cap 16 on the container 18. A pair of downwardly extending spaced apart tangs 44 are on the collar 42 to engage with and break the seal of the tamper proof zip strip 14 from the twist-off cap 16 so that the twist-off cap 16 can be rotated and removed from the container 18. The bottle cap remover portion 20 includes a cover 46 having a recessed aperture 48 to fit over the bottle cap 22 on the bottle 24. A downwardly projecting tongue 50 is on the cover 46 to engage with a crimped edge 52 of the bottle cap 22 so that the bottle cap 22 can be lifted off the bottle 24.

The carton top opener portion 26 is a fork 54 having two side prongs 56 and a middle pointed prong 58 shorter than the two side prongs 56. The middle pointed prong 58 can be inserted under the tabs 30 as shown in FIGS. 4 and 4A and lifted to break the seal 28 between the tabs 30 as shown in FIG. 5 and then form the pouring spout 35 by opening the two flaps 36 on the top 32 of the carton 34 as shown in FIG. 6.

The tool 10 can be fabricated out of a durable material such as plastic, metal, wood and the like in which the twist-off cap remover portion 12, the bottle cap remover portion 20, the carton top opener portion 26 and the first and second arm members 38 and 40 are all integral with each other.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combination cap remover and carton top opener tool comprising:

a) a twist-off cap remover portion to break the seal of a tamper proof zip strip from a twist-off cap on a container so as to remove the twist-off cap away from the container; said twist-off cap remover portion includes:

a collar sized to fit over the twist-off cap on the container; and a pair of downwardly extending spaced apart tangs on said collar to engage with and break the seal of the tamper proof zip strip from the twist-off cap so that the twist-off cap can be rotated and removed from the container;

b) a bottle cap remover portion to lift off a bottle cap from a bottle so as to remove the bottle cap away from the bottle;

c) a carton top opener portion to break the seal between a pair of tabs on top of a carton and form a pouring spout from two flaps;

d) a first arm member extending between said twist-off cap portion and said bottle cap remover portion; and e) a second arm member extending between said bottle cap remover portion and said carton top opener portion to aid a person in manually operating said tool.

2. A tool as recited in claim 1, wherein said bottle cap remover portion includes:

a) a cover having a recessed aperture to fit over the bottle cap on the bottle; and b) a downwardly projecting tongue on said cover to engage with a crimped edge of the bottle cap so that the bottle cap can be lifted off the bottle.

3. A tool as recited in claim 2, wherein said carton top opener portion is a fork having two side prongs and a middle pointed prong shorter than said two side prongs so that said middle pointed prong can be inserted under the tabs.

* * * * *